United States Patent [19]

Stumpe

[11] Patent Number: 4,637,772

[45] Date of Patent: Jan. 20, 1987

[54] LOADER MOUNT

[75] Inventor: Leroy Stumpe, Hartford, S. Dak.

[73] Assignee: Du-Al Manufacturing Company, Sioux Falls, S. Dak.

[21] Appl. No.: 649,686

[22] Filed: Sep. 12, 1984

[51] Int. Cl.[4] ..... E02F 3/62

[52] U.S. Cl. ..... 414/686; 172/274; 403/379

[58] Field of Search ..... 414/686; 172/272, 274, 172/275; 403/378, 379

[56] References Cited

U.S. PATENT DOCUMENTS

| | | | |
|---|---|---|---|
| 3,939,997 | 2/1976 | Frank | 172/275 X |
| 4,051,962 | 10/1977 | Westendorf | 414/686 |
| 4,217,075 | 8/1980 | Frank | 172/274 X |
| 4,247,242 | 1/1981 | Goertzen | 414/686 |
| 4,345,870 | 8/1982 | Anderson et al. | 172/274 X |
| 4,470,751 | 9/1984 | Masuzawa et al. | 414/686 |
| 4,554,978 | 11/1985 | Schneider | 414/686 X |

FOREIGN PATENT DOCUMENTS

| | | | |
|---|---|---|---|
| 164235 | 7/1980 | Netherlands | 414/686 |

*Primary Examiner*—Robert J. Spar
*Assistant Examiner*—Donald W. Underwood
*Attorney, Agent, or Firm*—Hill, Van Santen, Steadman & Simpson

[57] ABSTRACT

A mount for disconnectably attaching an appliance such as a loader on the front end of a tractor with the loader having a mounting frame with channels at each side receiving a front mount on the tractor, the frame also having a U-shaped stand which is pushed upwardly to a horizontal position by the tractor and which automatically moves downwardly to support the frame when the tractor is backed out of the frame, the frame also having rear mount columns with feet at the bottom which are received in sockets secured at the side of the tractor with the sockets having camming surfaces for pushing the feet to secured position and the feet having means for tightly pulling the feet at the base of the columns of the frame to secured position on the tractor.

8 Claims, 7 Drawing Figures

LOADER MOUNT

BACKGROUND OF THE INVENTION

The invention relates to improved structure for mounting devices such as a loader on the front end of a tractor, and more particularly to an improved loader attachment means which is capable of reliable, secure, quick attachment and detachment of a loader from the front end of a tractor.

Appliances or devices such as loaders are normally attached to tractors to provide a structure for lifting loading or moving material. The tractor is provided with a hydraulic pump for pressurizing hydraulic fluid to operate the loader. Where the loader is to be removed from the tractor and stored, or interchanged with another appliance, it is desirable to have a structure whereby the loader can be quickly detached and reattached to the tractor so that the tractor can be used for other applications.

Different structures have been employed for attaching the loader to the tractor which have generally consisted of mounting frames which are rigidly attached to the tractor and mating attachment means which are a part of the loader. These frames require some method for locking the loader to the tractor in a manner to withstand the forces and stresses which are encountered in operation of the loader. Conventional mounting frames consist of a front and rear structural frame member attached to each side of the tractor generally positioned at a permanently fixed distance apart. Other structures position the frame member at a selection of fixed distances apart.

When mounting a variety of loaders on a variety of tractor makes and models, it is desirable to position a front and rear tractor mounting frame so that they do not interfere with the tractor part, are reliably well supported and are relatively inexpensive to fabricate.

It is accordingly an object of the present invention to provide a mounting structure for detachably or releasably connecting an appliance such as a loader to the front end of a tractor wherein the attachment and detachment can be rapidly and reliably accomplished in a manner which is rigid and reliable so that continued operation of the loader and tractor may be relied upon.

A further object of the invention is to provide an improved mount for attaching a loader to a tractor wherein the mount is relatively easy and inexpensive to fabricate and is particularly well adapted to be used on a great variety of makes and models of tractors.

An important object of the invention is to provide an improved tractor mount for detachably attaching a loader to a tractor which has an improved correlation between the front and rear mount permitting safe, strong, rigid, reliable attachment and accommodating itself to use on a variety of makes and models of tractors.

A feature of the invention which serves the above stated objectives is to provide a rigid connection between the loader and the tractor mounting frames. It is important to prevent any movement between the loader structure and frame so that the loader functions as an integral part of the tractor. If relative movement is permitted, the tractor operator cannot operate and position the loader as readily as necessary and movement or play in the mechanism will soon cause wear of the parts, and instead of providing a safe secure mount, one results which is loose, noisy and undesirable from the standpoint of sales of the equipment and operation of the tractor. A further object of the invention is to provide a releasable mount which readily accommodates storing the loader when it is not attached to the tractor. This is done by parking the loader in a position where it can be immediately and easily reattached to the tractor by merely driving the tractor into the loader.

A feature of the invention is the provision of a quick attach loader which is attached to the tractor by front and rear tractor mounting frames and provides automatically for an infinite number of distances between the front and rear frames to thereby accommodate a great number of tractor makes and models.

The invention also accommodates a rigid connection between the loader and tractor mounting frames and a parking stand which automatically stores the loader frame and automatically holds the loader frame in position for reattachment when it is removed from the tractor.

A further feature of the invention is the provision of a parking stand which is readily vertically adjustable and accommodates attachments to tractors having different front end attachments of different heights. The usefulness of this feature is that it makes possible automatic attachment of the loader to the tractor by the tractor merely driving into the loader and the parts automatically coming into aligned position between the tractor and loader for firm attachment of the loader to the tractor.

Other objects, advantages and features will become more apparent with the teaching of the principles of the present invention in connection with the disclosure of the preferred embodiment thereof in the specification, claims and drawings in which:

DESCRIPTION OF THE PREFERRED EMBODIMENT

Figure 1:
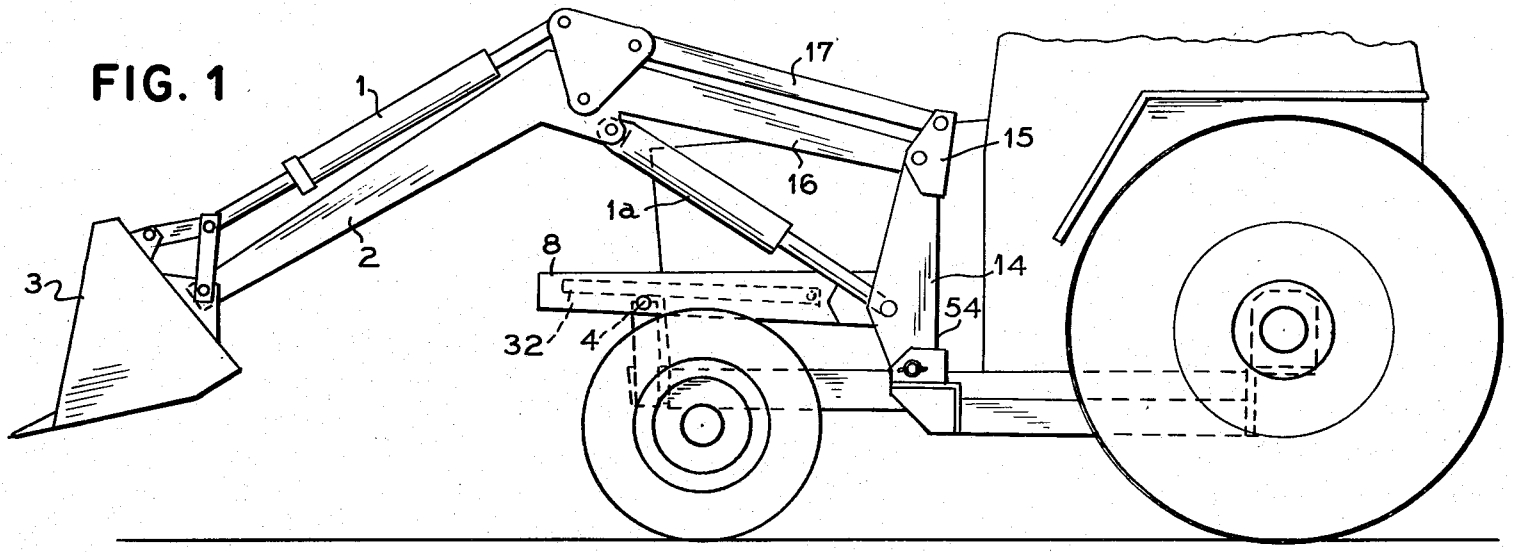
FIG. 1 is a side elevational view illustrating a tractor with a loader mounted thereon with structures constructed and operating in accordance with the principles of the present invention.
Figure 2:
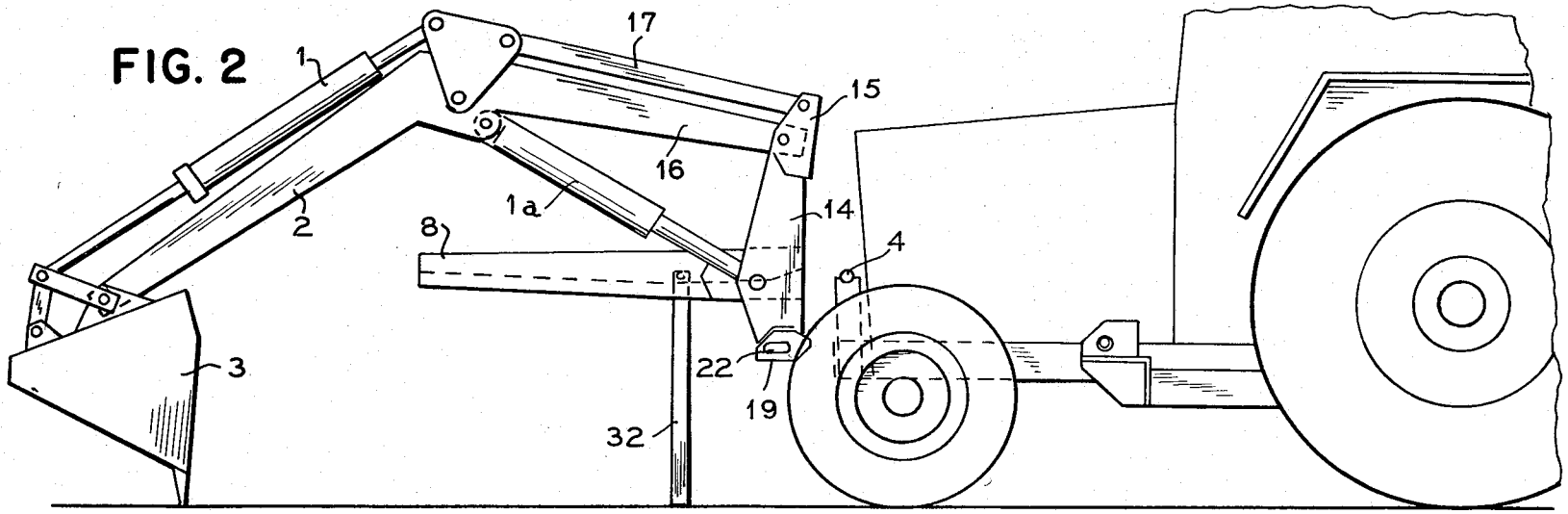
FIG. 2 is a side elevational view illustrating the loader removed from the tractor and stored ready for reattachment.
Figure 3:
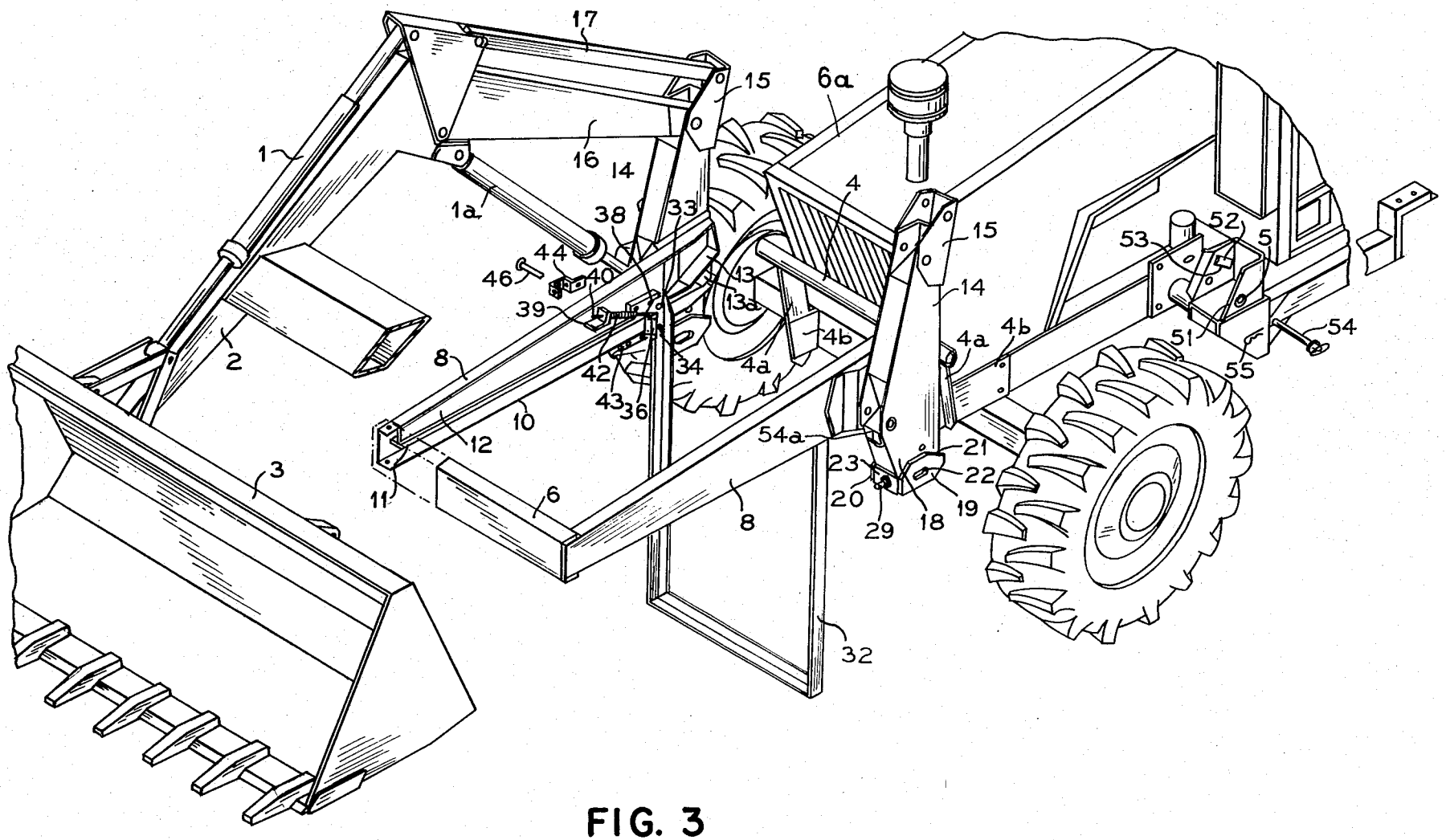
FIG. 3 is a perspective view, with parts removed, illustrating the details of the loader and tractor parts for mounting the loader on the tractor.

As illustrated in FIGS. 1 through 3, a tractor operated appliance, such as a loader, includes a scoop 3 pivotally mounted at the lower end of side arms 2. The side arms will be provided with a particular construction to permit pivotal movement of the scoop 3 which may be controlled by a hydraulic piston and cylinder 1.

Similarly, the side arms are constructed so as to be able to raise and lower the scoop by hydraulic mechanism including a piston and cylinder la, and this equipment primarily forms no part of the present invention. Reference will be made to the scoop for purposes of illustration only and it will be understood that while the mounting equipment is particularly well adapted to use with a scoop or shovel, it may be utilized with other hydraulic tractor equipment.

Primarily, the equipment will have side columns or posts 14 which are vertical and rigid and are laterally spaced a predetermined distance. In the present instance at the top end of the columns 14, is a member 15 which is a rigid extension of the column 14 and parallelogram arms 16 and 17 are pivotally attached to the top of the column and the member 15 for utilization in the support and operation of the scoop, and these members also carry the hydraulic lines which are used to operate the scoop.

Figure 7:
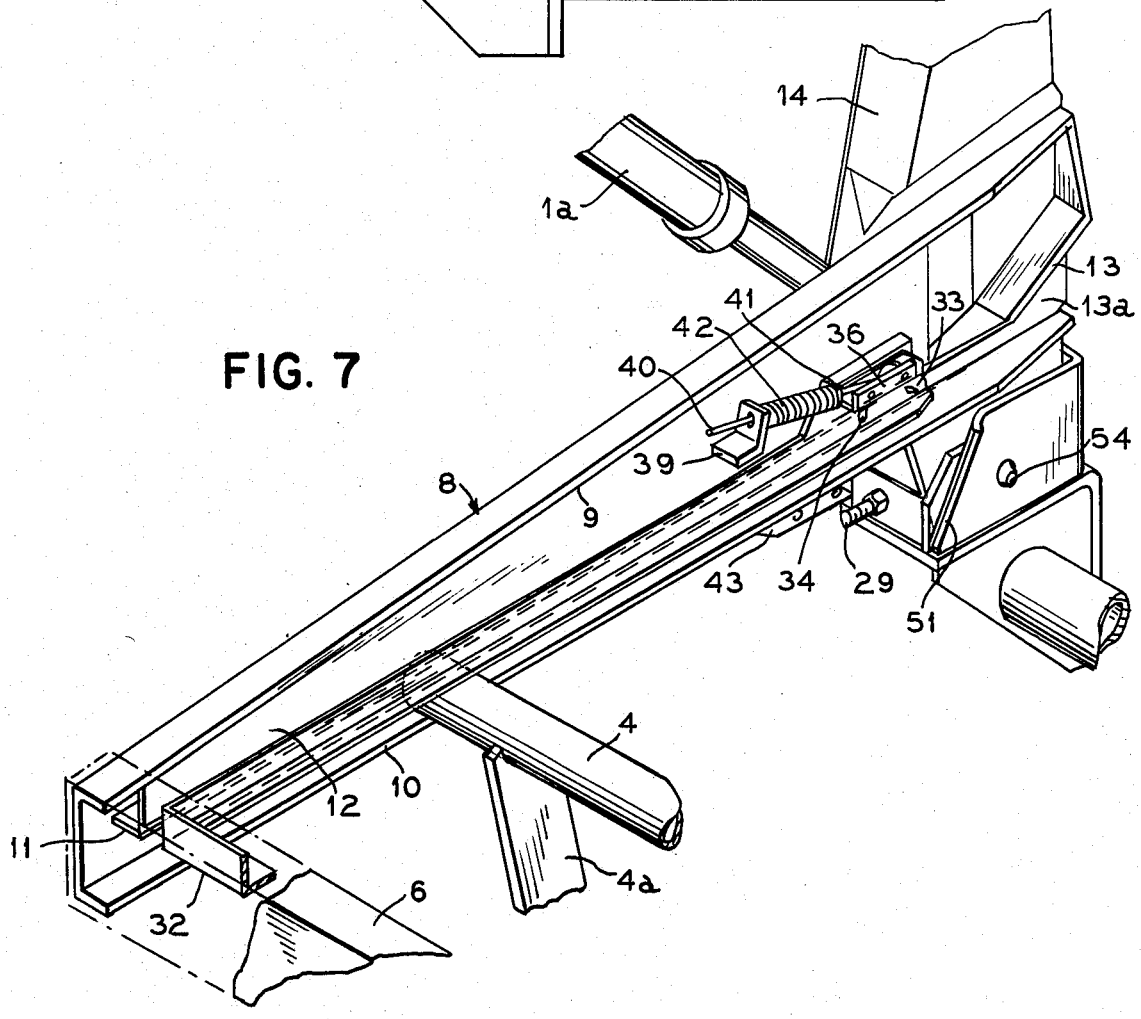
FIG. 7 is an enlarged fragmentary perspective view showing the relationship of the parts at the front end of the tractor when the loader is mounted thereon.

As illustrated in FIGS. 3 and 7, the mounting apparatus for the scoop includes a horizontally extending U-shaped fabrication with an outer cross member 6 and two side channels 8. The side channels are assembled so as to be facing inwardly and on the inner surface of the channels is a horizontally extending plate 11 which is welded within the inner face of the channel. At the top surface of the plate 11 is a vertical plate 12 which extends the full length of the horizontal supporting plate 11. The two plates 11 and 12 provide a guide, along with a bottom lip 10 of the channel 8, for receiving the ends of a cross rod 4 at the front end of the tractor. The cross rod 4 is shown as being hollow and is suitably mounted on the front end of the tractor which is shown generally at 6*a*. The tractor is shown in position just prior to attachment to the loader or just after being detached.

The cross rod 4 is shown supported on vertical struts 4*a* which are L-shaped with a lower portion 4*b* bolted onto the sides of the tractor. The cross rod will thus be fixed with respect to the front of the tractor, and as the loader is positioned onto the front of the tractor, the ends of the cross rod will slide under a cam surface 13 at 13*a* into the channels 8 at each side of the loader frame. Since the channels present a horizontal elongated guide for ends of the cross rod, the ends of the cross rod can slide as far as they wish, but the limit of sliding will be determined by the home position of the rear mount which will be described in detail.

Both sides 8 are constructed similarly so that one side takes one end of the rod 4 and the other side takes the other end. As the ends of the rod slide under the camming surface 13, they raise the back end of the loader to release a U-shaped stand 32. The U-shaped stand supports the rear end of the loader when it is not on the tractor. The U-shaped stand is pivotally connected to the loader frame at 33.

The U-shaped parking stand 32 is normally urged to swing downwardly toward the parking position by a sliding rod 40 which carries a coiled compression spring 42. This rod is attached at its lower end to the parking stand to push it downwardly, and slides in its upper end in a small bracket 39 which forms a base for the compression spring 42 and a collar 41 on the rod forms the other base so that the spring tends to urge the rod to push the parking stand downwardly. A stop is provided which prevents the stand from swinging beyond the vertical position.

The stand 32 is adjustable in height. When the parking stand is set to hold the sides 8 of the frame in their highest position, the upper hole 33 is employed. When the frame sides are to be at a lower position, the lower hole 34 is employed for its pivot position. Similar accommodating holes are provided in a clevis 36 which provides the base for the rod 40 and the upper hole in the clevis is used when the upper hole 33 of the stand is employed, and similarly the lower hole in the clevis is used when the lower hole 34 in the stand is employed.

Means are provided for locking the parking stand 32 in its down position after the tractor has been backed away so the unit will not inadvertently collapse. For this purpose a pin 46 slides in a hole in a bracket 44 to a corresponding hole in a bar 43. The bar 43 has hole positions which allow mounting the bracket 44. The bracket 44 also has fore and aft holes for storage of the pin 46 when not in use.

When the tractor is driven forwardly into the loader, the ends of the rod 4 slide into the channels at 13*a* on each side of the frame. The channels have the inclined guiding surface such as 13 to guide the ends of the rod into the channel 13*a*. The surface 13 is inclined downwardly so that when the end of the rod enters the channel, the channel will be lifted to release the stand 32. As the tractor continues to move forwardly, the rod 4 engages the stand pushing it forwardly up to its tucked-up folded position. As it approaches folded position, the spring loaded rod 40 shifts its line of action to where it is above the pivot point 38, thus tending to hold the stand in the recessed raised position. While details are shown of one side of the stand, it will be understood that each of the sides 8 of the stand are similarly constructed.

The ends of the rod 4 will be slid as far forwardly into the sides 8 as required to lock the back of the loader onto the tractor. That is, with different tractors the rear connection will be different distances from the front and the present structure will accommodate a substantial range of lengths between the front rod 4 and the rear connection.

Figure 5:
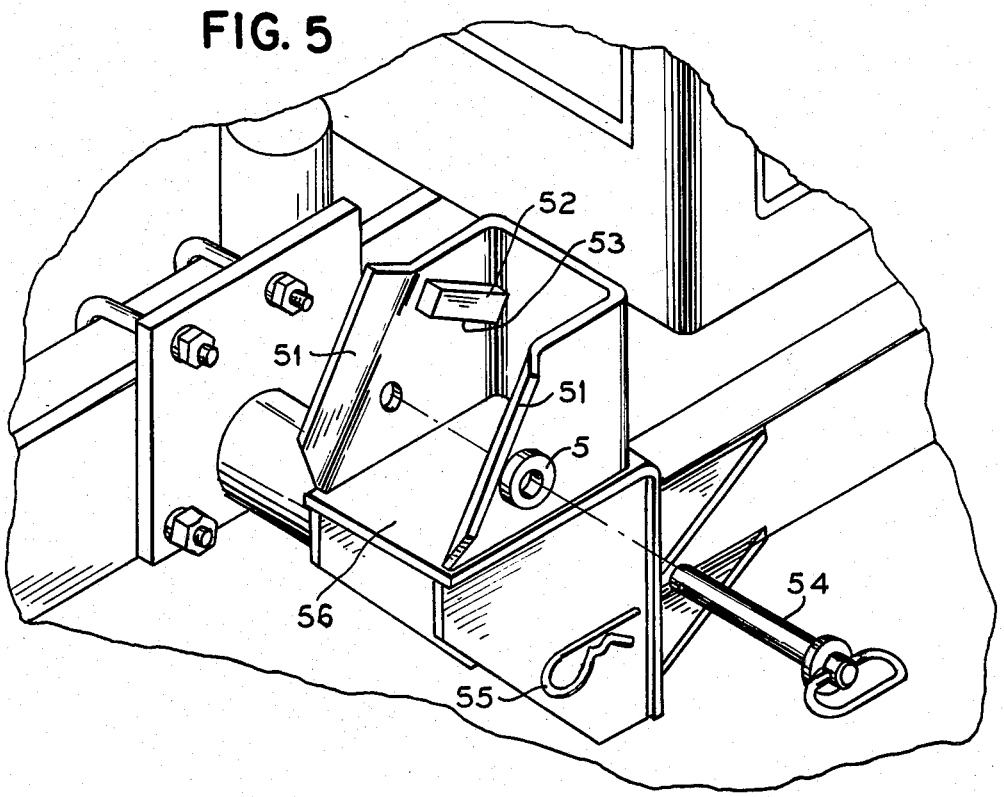
FIG. 5 is an enlarged perspective view of a fragmentary portion of the part mounted on the tractor for securing the loader thereto.
Figure 6:
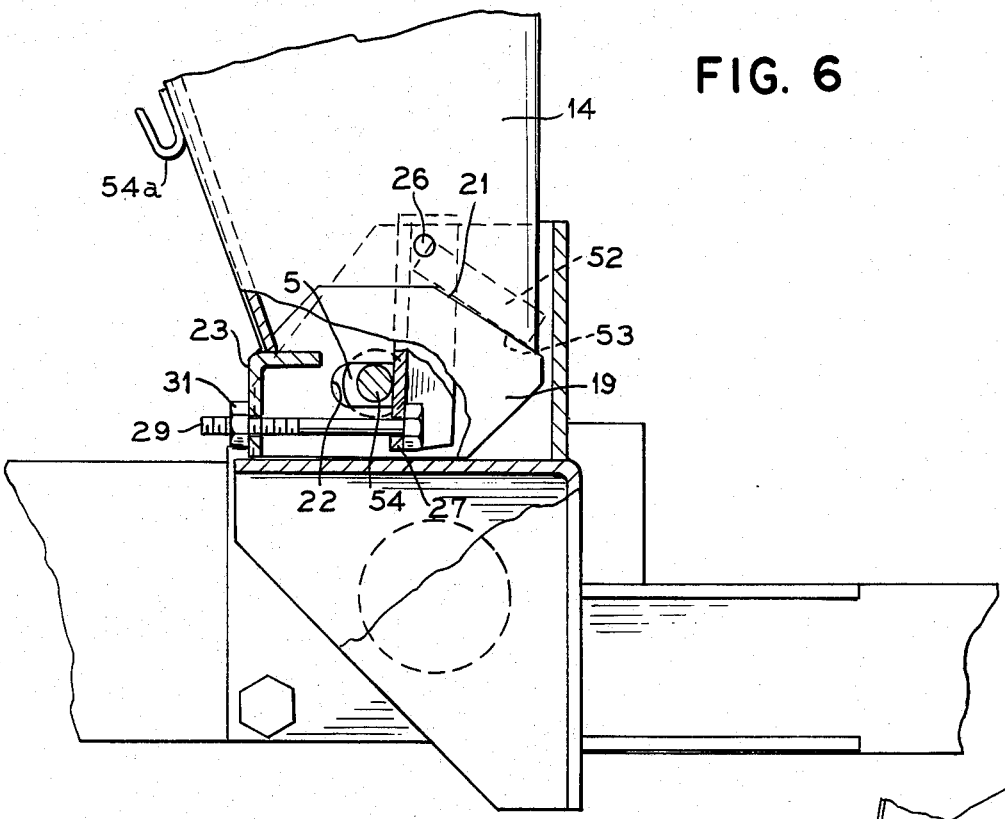
FIG. 6 is an elevational view with parts broken away showing the rear locking part of the loader inserted in place and locked onto the tractor.

The rear connection is shown in FIG. 3 and in enlarged form in FIG. 5. The part of the loader which engages the rear stand includes a vertical column 14 on each side of the loader, and a foot at the bottom of the column slides into a receiving pocket on each side of the tractor.

Figure 4:
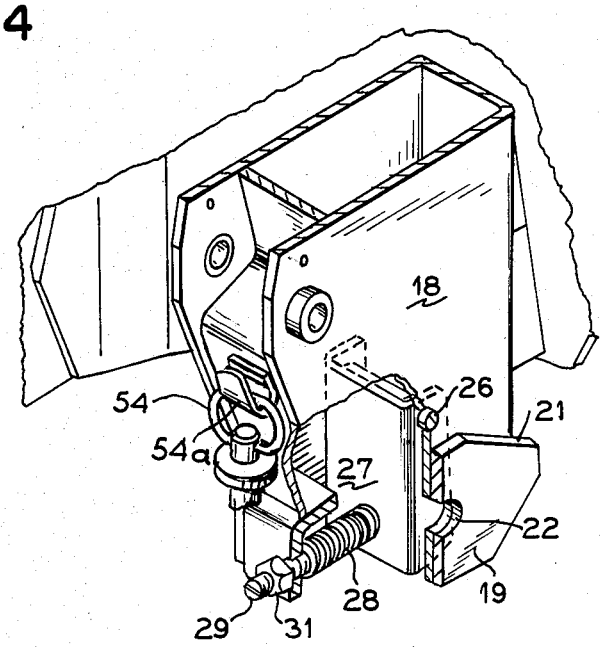
FIG. 4 is an enlarged perspective view of a fragmentary portion of the loader which is received by the tractor to lock the loader in position on the tractor.

As the tractor moves forwardly, the lower end or foot 18 of the column, which is shown in detail in FIG. 4, enters the pocket 56, FIG. 5. The pocket member is bolted or otherwise attached onto the side of the tractor. The pocket is shaped with lateral guide flanges 51 which help guide the foot 18 into the pocket. When the foot 18 is fully seated in the rearmost part of the pocket 56, inclined surfaces 21 on foot side plates 19 on each side of the foot ride beneath an inclined surface 53 on holding cams 52 on each side of the pocket. This causes the foot 18 to seat firmly in the base of the pocket 56 and the location of the cam surfaces 53 are so positioned relative to the surfaces 21 that at the rearmost position of the foot, it will be firmly pushed down to the floor of the pocket.

A cross-pin 54 is then slid into holes in bosses 5 on each side of the pocket. The pin passes into horizontally oblong holes 22 on each side of the foot. This will position the pin in front of a vertical pivot plate 27. The pivot plate is pivoted at its upper edge on a pin 26 which supports it in the hollow center of the fabricated foot. A coil compression spring 28 on a bolt 29 continues to urge the plate 27 toward its rearmost position. When the pin is in place, a locking key 55 is slid through a hole in the pin.

A nut 31 on the bolt 29 is then tightened drawing the plate 27 forwardly. The plate pressing against the side of the pin 54 functions to push the foot firmly back into the pocket. By tightening the nut 31, the plate is pulled forwardly against the horizontal pin 54 and the nut 31 acting on the forward surface 23 of the column pushes the foot firmly back into the pocket.

The rear part of the loader is thus firmly attached onto the tractor, and the front part of the loader will be fully supported on the ends of the rod 4.

For disconnecting of the loader, the nut 31 is loosened to permit the plate 27 to be pivoted rearwardly and free its pressure against the pin 54. The pin 54 is then pulled out of the hole in the bosses 5, and the pin is hung on a simple hook holder **54*a*** on the front of the foot. The tractor can then be backed out so that the stand drops down.

The scoop 3 is first lowered onto the ground to support the front end of the loader, and as the tractor is backed away, the ends of the rod 4 will slide along the channels **13*a* until the stand 32 is in an upright position on the ground. Continued backing of the tractor will move the ends of the rod 4 out of the channels 13*a*** leaving the loader in its position supported on the ground.

In storage the loader will be in a stored position with the scoop 3 on the ground supporting the forward end, and the U-shaped stand 32 supporting the rear end.

When the scoop is again to be used, the tractor is aligned with the loader and driven forwardly so that the ends of the rod 4 enter the channels **13*a* on each of the sides 8. The sloping cam surface 13 will receive the ends of the rod 4 which will lift the rear of the loader slightly so that the stand 32 can pivot forwardly. As the ends of the rod 4 move forwardly, they engage the stand to pivot it forwardly and upwardly. As the tractor continues to be driven forwardly, the feet 18 at the bottom of the columns 14 enter the side pockets on the tractor. The cam surfaces 21 on each side of the columns pass beneath cam surfaces 53 in the pockets locking the foot of each column firmly into the pockets. For holding the foot in its rearmost locked position, a cross-pin 54 is slid through the opening in the bosses 5 in the pockets and an oblong opening 22 in the columns. The nut 31 of the bolt 29 is tightened pulling the pivoted plate 27 forwardly against the pin 54** to firmly urge and lock the foot of the column into the pocket.

Thus, it will be seen that I have provided a mounting structure for a loader which meets the objectives and advantages above set forth. The structure can be accommodated by a substantial variety of tractors which have a varying length from the front to the sides and the front end of the loader will be adequately supported in a great variety of positions of the rod 4 along the tracks **13*a*** at the sides of the loader. Firm support will be had for operation of the loader and the loader can easily be removed and stored and quickly reattached when it is again to be used.

I claim as my invention:

1. A mount for disconnectably attaching an appliance such as a loader on the front end of a tractor comprising in combination:

a loader mounting frame having a rear side attachment insertion structure at each side;

a receiving member for being secured on each side of a tractor; said receiving member having a floor against which said rear insertion structure seats;

a first guide surface on the receiving member angled toward said floor in a rearward direction;

a correspondingly angled second guide surface on the insertion structure positioned to slide against the first surface and force the insertion structure against the floor in a rearward movement of the mounting frame;

locking means holding the insertion structure in its rearward locked position;

a forward attachment structure on the frame;

and a mating forward attachment member for being secured on the tractor and receiving said forward attachment structure;

said locking means including a cross-pin extending through mating openings in the insertion structure and receiving member, said receiving openings in one of said insertion structure or receiving members being enlarged in a forward direction and said locking means including means for applying a forward force to the cross-pin.

2. A mount for disconnectably attaching an appliance such as a loader on the front end of a tractor constructed in accordance with claim 1:

including a pivoted member with means for applying a force to said pivoted member against said cross-pin to apply a locking force for holding the insertion structure in its locked position.

3. A mount for disconnectably attaching an appliance such as a loader on the front end of a tractor constructed in accordance with claim 2:

including a forwardly extending bolt between the pivoted member and said insertion structure for drawing the pivoted member against said cross-pin.

4. A mount for disconnectably attaching an appliance such as a loader on the front end of a tractor comprising in combination:

a loader mounting frame having a rear side attachment insertion structure at each side;

a receiving member for being secured on each side of a tractor; said receiving member having a floor against which said rear insertion structure seats;

a first guide surface on the receiving member angled toward said floor in a rearward direction;

a correspondingly angled second guide surface on the insertion structure positioned to slide against the first surface and force the insertion structure against the floor in a rearward movement of the mounting frame;

locking means holding the insertion structure in its rearward locked position;

a forward attachment structure on the frame;

and a mating forward attachment member for being secured on the tractor and receiving said forward attachment structure;

said locking means including a cross-pin extending through mating openings in the insertion structure and receiving member, said locking means including a set of mating openings in said receiving member and attachment structure with a cross-pin extending through said openings with one set of openings being elongated in a forward direction and the structure including means for applying a force to a cross-pin extending through said openings.

5. A mount for disconnectably attaching an appliance such as a loader on the front end of a tractor comprising in combination:

a loader mounting frame having a front mounting structure including channels at each side of the frame with rods to be secured on the tractor to be slidably received by said channels for supporting the front of an appliance;

a rear mounting structure including a vertical post at each side of the frame with a base having a side attachment insertion structure at each side;

a receiving member for being secured to each side of the tractor to receive the insertion structure; said receiving member having an upwardly facing open U-shaped element with a floor against which the insertion structure seats;

first angled guide surfaces inside of the U-shaped element angled toward said floor;

a correspondingly angled second guide surface on the post of the insertion structure positioned to slide against the first surface and force the insertion structure against the floor in a rearward movement of the mounting frame relative to the tractor;

correspondingly cross-extending openings in the insertion structure and the receiving member for receiving a locking pin with the openings in the receiving structure being elongated in a rearward direction;

a locking means including a cross-pin for insertion into the openings;

including a downwardly depending plate for engagement against said locking pin;

and including a forwardly extending bolt on the plate to be received by the insertion member for drawing the plate against the cross-pin and drawing the insertion member rearwardly to locked position.

6. A mount for disconnectably attaching an appliance such as a loader on the front end of a tractor comprising in combination:

a loader mounting frame having a rear side attachment insertion structure at each side;

a receiving member for being secured on each side of a tractor;

camming means having coacting mating surfaces on said receiving member and on said insertion structure for camming the insertion structure to a home position as it is moved rearwardly;

locking means applying a rearwardly directed force to the insertion structure holding the mating surfaces in said home position;

a forward attachment structure on the frame;

and a mating forward attachment structure for mounting on a tractor; one of said forward attachment structures including horizontally extending channels at each side of the tractor and the other of said structures including pins for mounting on the tractor to be received by the channels and to slide a distance in the channels determined by the location of said home position.

7. A mount for disconnectably attaching an appliance such as a loader on the front end of a tractor constructed in accordance with claim 6:

including a U-shaped stand on the frame pivotal to a vertical position when the mounting frame is removed from the tractor and when the frame is to be attached to the tractor.

8. A mount for disconnectably attaching an appliance such as a loader on the front end of a tractor constructed in accordance with claim 7:

including adjustment means on the stand wherein the stand is vertically adjustable for accommodating different tractor heights.

* * * * *